US009120646B2

(12) United States Patent
Loeb et al.

(10) Patent No.: US 9,120,646 B2
(45) Date of Patent: Sep. 1, 2015

(54) SYSTEMS AND METHODS FOR DETERMINING FUNCTIONALITY OF AN AUTOMATIC DOOR SYSTEM

(75) Inventors: Ruediger Loeb, Hennigsdorf (DE); Peter Herkel, Berlin (DE)

(73) Assignee: OTIS ELEVATOR COMPANY, Farmington, CT (US)

( * ) Notice: Subject to any disclaimer, the term of this patent is extended or adjusted under 35 U.S.C. 154(b) by 784 days.

(21) Appl. No.: 13/377,768

(22) PCT Filed: Jul. 17, 2009

(86) PCT No.: PCT/US2009/050989

§ 371 (c)(1),
(2), (4) Date: Dec. 12, 2011

(87) PCT Pub. No.: WO2011/008214

PCT Pub. Date: Jan. 20, 2011

(65) Prior Publication Data

US 2012/0325588 A1 Dec. 27, 2012

(51) Int. Cl.
*B66B 13/14* (2006.01)
*B66B 13/26* (2006.01)

(52) U.S. Cl.
CPC ..... *B66B 13/143* (2013.01); *B66B 13/26* (2013.01)

(58) Field of Classification Search
CPC .... B66B 5/0015; B66B 5/0025; B66B 13/02; B66B 13/143; B66B 13/26
USPC ..... 187/247, 316, 317, 391–393; 49/26, 28; 318/280–286, 466–470
See application file for complete search history.

(56) References Cited

U.S. PATENT DOCUMENTS

| | | | |
|---|---|---|---|
| 4,300,660 | A | 11/1981 | Schoenmann et al. |
| 4,300,661 | A | 11/1981 | Hmelovsky |
| 4,300,662 | A | 11/1981 | Hmelovsky |
| 4,300,663 | A | 11/1981 | Hmelovsky et al. |
| 4,305,481 | A | 12/1981 | Hmelovsky et al. |

(Continued)

FOREIGN PATENT DOCUMENTS

| | | | |
|---|---|---|---|
| CN | 101353129 | A | 1/2009 |
| JP | 2003/168962 | A | 6/2003 |

(Continued)

OTHER PUBLICATIONS

International Search Report and Written Opinion from related International Application No. PCT/US2009/050989; report dated Apr. 5, 2010.

(Continued)

*Primary Examiner* — Anthony Salata
(74) *Attorney, Agent, or Firm* — Cantor Colburn LLP

(57) ABSTRACT

Automatic door systems and methods capable of determining proper functionality thereof are provided. The door systems are provided with a healthcheck module which automatically determines functionality of the door system by initially monitoring a first output signal provided by a first sensor and a second output signal provided by a second sensor. More specifically, the healthcheck module correlates the first output signal with the second output signal and operates one or more doors of a door system according to the correlation. The healthcheck module then monitors the second output signal provided by the second sensor to determine the ability of the one or more doors to close, and determines functionality of the door system accordingly.

21 Claims, 5 Drawing Sheets

(56) References Cited

U.S. PATENT DOCUMENTS

| | | | | |
|---|---|---|---|---|
| 4,342,378 | A | 8/1982 | Hmelovsky | |
| 4,342,379 | A | 8/1982 | Games et al. | |
| 4,750,591 | A * | 6/1988 | Coste et al. | 187/391 |
| 4,930,604 | A * | 6/1990 | Schienda et al. | 187/393 |
| RE33,668 | E | 8/1991 | Gray | |
| 5,042,620 | A | 8/1991 | Yoneda et al. | |
| 5,149,921 | A | 9/1992 | Picado | |
| 5,410,149 | A | 4/1995 | Winston, Jr. et al. | |
| 5,567,931 | A | 10/1996 | Amend et al. | |
| 5,696,362 | A | 12/1997 | Amend | |
| 5,760,350 | A * | 6/1998 | Pepin et al. | 187/316 |
| 5,841,083 | A | 11/1998 | Schönauer et al. | |
| 5,884,237 | A * | 3/1999 | Kanki et al. | 702/113 |
| 6,225,768 | B1 * | 5/2001 | Cookson et al. | 318/280 |
| 6,392,537 | B1 * | 5/2002 | Tazumi et al. | 340/507 |
| 6,484,125 | B1 * | 11/2002 | Huang et al. | 702/183 |
| 6,516,923 | B2 * | 2/2003 | Lence Barreiro et al. | 187/391 |
| 6,547,042 | B1 | 4/2003 | Collins | |
| 6,854,565 | B2 * | 2/2005 | Perala et al. | 187/393 |
| 7,020,213 | B2 | 3/2006 | Kunikata | |
| 7,093,692 | B2 | 8/2006 | Koura | |
| 7,109,677 | B1 * | 9/2006 | Gagnon et al. | 318/466 |
| 7,140,469 | B2 | 11/2006 | Deplazes et al. | |
| 7,181,369 | B2 * | 2/2007 | Kanki et al. | 702/188 |
| 2005/0174077 | A1 * | 8/2005 | Haag et al. | 318/280 |
| 2006/0144643 | A1 | 7/2006 | Koura | |
| 2014/0262629 | A1 * | 9/2014 | Toutaoui | 187/393 |

FOREIGN PATENT DOCUMENTS

| | | | |
|---|---|---|---|
| JP | 2004/299875 | A | 10/2004 |
| JP | 2006/168843 | A | 6/2006 |
| JP | 2009/029583 | A | 2/2009 |
| WO | WO-00/47511 | | 8/2000 |
| WO | WO-2006/065804 | A2 | 6/2006 |

OTHER PUBLICATIONS

Office Action for related Chinese Application No. 200980160598.8; Action dated Jul. 26, 2013.

* cited by examiner

SYSTEMS AND METHODS FOR DETERMINING FUNCTIONALITY OF AN AUTOMATIC DOOR SYSTEM

CROSS-REFERENCE TO RELATED APPLICATIONS

This application is a U.S. national stage filing of International Patent Application No. PCT/US09/50989, filed on Jul. 17, 2009.

FIELD OF THE DISCLOSURE

The present disclosure generally relates to safety control systems, and more particularly, relates to a method and apparatus for monitoring the functionality of safety devices associated with automatic door systems.

BACKGROUND OF THE DISCLOSURE

Automatic door systems are commonly used in a wide variety of different applications. For instance, automatic doors may be used to provide facilitated entry to and exit from structures such as buildings, vehicles, garages, elevators, and the like. Automatic door systems may generally include one or more doors, at least one sensor for detecting a person or object approaching and/or passing through the doors, at least one drive mechanism for opening or closing the doors, and a control unit for managing the overall operation of the door system. Automatic door systems may be configured to any one of a variety of different configurations. For example, the one or more doors of an automatic door system may be foldably, slidably, rotatably or hingably disposed along a common pathway thereof.

As with most automated systems, automatic door systems are left to operate continuously for extended periods of time, and generally, without supervision. Accordingly, it is increasingly important to provide automatic door systems with sufficiently reliable safety measures to ensure the safety of users and passengers. Although currently existing door systems are provided with several measures to safeguard passengers, there are several drawbacks. In elevator door systems, for example, it is common to use one or more automatic sliding doors. Detection devices may be provided to detect the presence of passengers or other obstructions in the path of the doors before and during closure to prevent harm to passengers, and further, to prevent damage to the door system. In the event of an obstruction, typical elevator door systems may be configured to prevent the elevator doors from closing further and reopen them.

One currently known system for detecting objects in the path of an elevator door places a light beam in a path across the door opening and uses a sensor to detect an interruption of the light beam, which would occur if an obstruction is in a pathway of the door. Upon sensing the interruption, the sensor issues a signal to alter the control of the door operation and reopens the door. However, such a system only detects obstructions in the path of the door and does not detect other issues that may prevent the door from closing properly such as a malfunctioning door track or motor.

Another known system for detecting door obstructions includes an incremental encoder for providing speed or position feedback. The encoder operates by having a rotatable encoder shaft connected to a door motor shaft so as to rotate conjointly therewith. The number, direction and speed of encoder shaft rotations thus indicate the direction of movement, speed and position of the elevator door. Thus, the encoder provides the capability to detect deviations in the motion of the door.

Another known system for detecting door obstructions includes a current sensor to detect an increase in a load of a door motor. This detection system determines that an obstruction exists if a current of the door motor increases. However, variations in a mechanical load, such as the weight of the landing doors in the elevator system, influence the performance of this type of detection system. The weight of the landing doors can vary significantly from landing to landing. The motor current is adjusted to provide compensation for the varying weight such that a desired speed profile is achieved. For example, a relatively heavy door requires an increased motor current. The increased current, however, can be falsely interpreted by the detection system as an obstruction. Additionally, costs associated with the sensor and its associated components, such as means to transmit information from a high voltage point to a low voltage point, are relatively high.

In light of the foregoing, the present application aims to resolve one or more of the aforementioned issues that can affect conventional door systems.

SUMMARY OF THE DISCLOSURE

In light of the foregoing, safeguards are needed to protect users and passengers if the sensors and detection devices should malfunction or fail, i.e., there is a need for a redundant, cost-effective and self-reliant safety device for automatic door systems. Furthermore, there is a need for a healthcheck system that may easily be implemented into both new and existing automatic door systems without requiring the addition of substantial hardware. More specifically, there is a need for a healthcheck device and/or module that automatically correlates two or more detected parameters of a door safety device and determines if the safety device is functional based on the correlation. Additionally, there is a need for a device capable of responding to a detected malfunction by notifying the respective personnel, sounding an alarm, shutting down operation of the door, or the like. The present application aims to address at least one of these various needs.

In accordance with one aspect of the disclosure, a method for determining functionality of an automatically closing door system is provided. The method comprises the steps of monitoring an obstruction signal output by a first sensor configured to detect an obstruction in a pathway of a door of the door system, the obstruction signal corresponding to one of at least three states including a normal state, a first abnormal state and a second abnormal state; closing the door at a first speed if the obstruction signal corresponds to the normal state; closing the door at a second speed if the obstruction signal corresponds to any one of the first and second abnormal states, the second speed being slower than the first speed; monitoring a door position signal output by a second sensor configured to detect a current position of the door, the door position signal corresponding to one of at least three states including a closed state, an open state and a blocked state; and declaring the door system as malfunctioning if the obstruction signal corresponds to the first abnormal state and the door position signal corresponds to the closed state, or the obstruction signal corresponds to the second abnormal state and the door position signal corresponds to the blocked state.

In accordance with another aspect of the disclosure, an automatic door system capable of determining proper functionality thereof is provided. The automatic door system comprises at least one door automatically movable along a pathway of the door system; at least one obstruction sensor configured to detect an obstruction in the pathway and output an obstruction signal; at least one position sensor configured to detect a position of the door along the pathway and output a position signal; a control unit configured to receive the obstruction and position signals and output command signals; a drive unit configured to receive the command signals from the control unit and drive the door; and a healthcheck module configured to: (a) monitor a correlation between the obstruction and position signals; (b) determine if the door system is malfunctioning based on the correlation; and (c) call attention to the door system if the door system is malfunctioning.

In accordance with another aspect of the disclosure, an elevator system is provided. The elevator system comprises a hoistway having one or more hoistway doors; a car configured to move vertically within the hoistway, the car having a door system, the door system being capable of determining proper functionality thereof, the door system comprising at least one door automatically movable along a pathway of the door system; at least one obstruction sensor configured to detect an obstruction in the pathway and output an obstruction signal; at least one position sensor configured to detect a position of the door along the pathway and output a position signal; a control unit configured to receive the obstruction and position signals and output command signals; a drive unit configured to receive the command signals from the control unit and drive the elevator door; and a healthcheck module configured to monitor a correlation between the obstruction and position signals; determine if the door system is malfunctioning based on the correlation; and output a notification signal to a notification system to call attention to the door system if the door system is malfunctioning.

These and other aspects of this disclosure will become more readily apparent upon reading the following detailed description when taken in conjunction with the accompanying drawings. It is to be understood that both the foregoing general description and the following detailed description are exemplary and explanatory only, and are not restrictive of the subject matter as claimed.

BRIEF DESCRIPTION OF THE DRAWINGS

These and other features, aspects, and advantages of the present application will become apparent from the following description, appended claims, and the accompanying exemplary embodiments shown in the drawings, which are hereafter briefly described.

DETAILED DESCRIPTION

Figure 1:
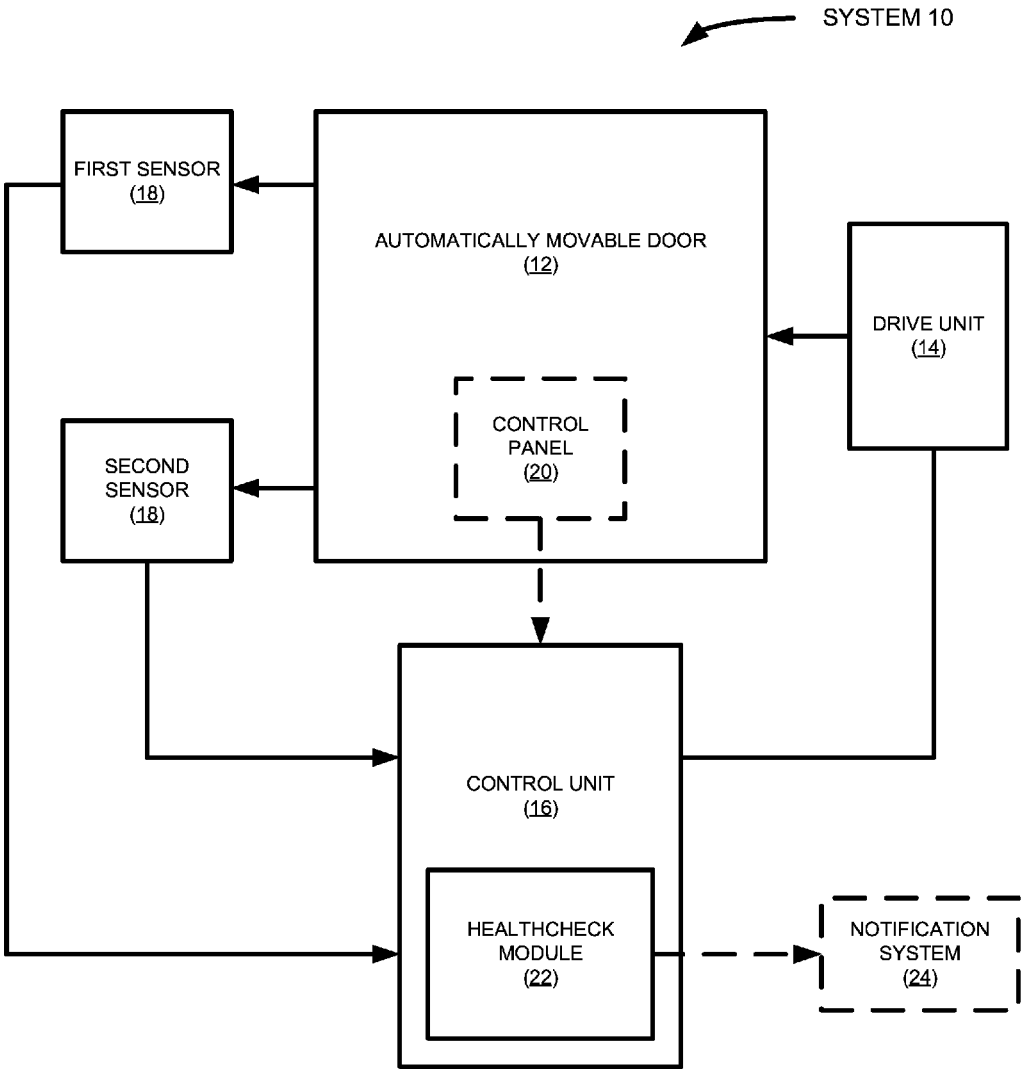
FIG. 1 is a schematic of an automatic door system employing an embodiment of a healthcheck device constructed in accordance with the teachings of the disclosure.

Efforts have been made throughout the drawings to use the same or similar reference numerals for the same or like components.

Referring to the drawings and with particular reference to FIG. 1, an exemplary door system incorporating a healthcheck device is provided and referred to as reference number 10. It is understood that the teachings of the disclosure can be used to construct automatic door systems with healthcheck measures above and beyond that specifically disclosed below. One of ordinary skill in the art will readily understand that the following are only exemplary embodiments.

As shown in FIG. 1, an exemplary door system 10 is provided with at least one automatically movable door 12 which may provide entry to or exit from a structure such as a building, vehicle, garage, elevator, or the like. The door system 10 may employ one or more doors 12 that are slidably, rotatably or pivotably movable along a pathway of the door system 10. Movement of the door 12 may be provided by a drive unit 14, such as a motor, or the like. Control of the movement of the door 12 may be managed by a control unit 16. The door system 10 may further include a first sensor 18 configured to detect the current state (i.e., location and direction, if any, of travel) of the movable door 12 and a second sensor 19 configured to detect an obstruction in the pathway of the movable door 12.

More specifically, the first sensor 18 may be an encoder that is associated with the drive unit 14 which outputs a signal corresponding to the current position of the door 12. Alternatively, the first sensor 18 may be a mechanical latch, switch, or the like, configured to output a signal indicating whether the door 12 is opened and/or closed. The second sensor 19 may be a proximity sensor which detects a passenger or obstruction in the vicinity of or in the pathway of the one or more doors 12. Moreover, the second sensor 19 may include one or more emitters and receivers disposed in close proximity to the door 12. Each emitter may be configured to emit radiation or light to a corresponding receiver. Each receiver may output a signal corresponding to the amount of radiation received. Accordingly, a break in the light or radiation received by the receiver caused by a user, passenger or obstruction in the pathway of the door system 10 may result in a significant change in the output signal for the duration of the blockage. In some applications, the door system 10 may also provide a control panel 20 configured to allow users to selectively operate the door 12. For example, in elevators, the control panel 20 may allow users to input commands for opening the door 12, closing the door 12, selecting the desired destination or floor, and the like.

The control unit 16 may be a microcontroller, microprocessor, or the like, that is preprogrammed or embedded with a predefined algorithm for operating the door system 10. As shown in FIG. 1, the control unit 16 may be in electrical communication with the outputs of the door position sensor 18 and the obstruction sensor 19. The control unit 16 may also be in electrical communication with the input of the drive unit 14. If applicable, the control unit 16 may also receive an output signal provided by a control panel 20, or the like. Among other things, the control unit 16 may monitor the signals provided by the sensors 18, 19 for unsafe conditions and respond accordingly. For example, if the output of the obstruction sensor 19 indicates an obstruction in the pathway of the door 12 while the output of the door position sensor 18 indicates that the door 12 is closing, the control unit 16 may be preprogrammed to output signals instructing the drive unit 14 to stop closing the door, reopen the door, or the like. The control unit 16 may also include a healthcheck module 22 which serves to monitor the health or functionality of the door system 10, and more particularly, the reliability of the sensors 18, 19.

Figure 2:
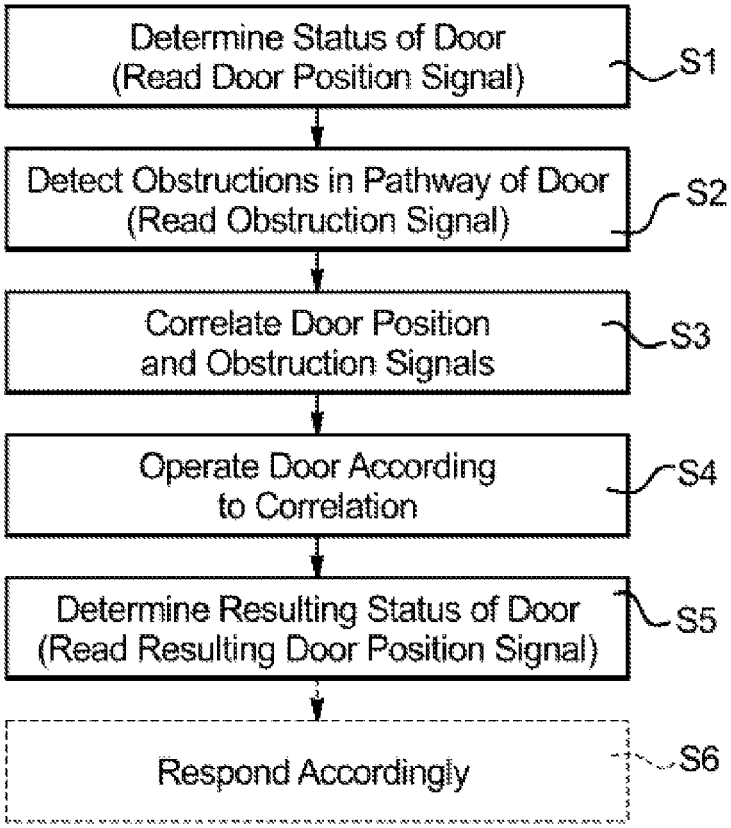
FIG. 2 is a flow chart outlining the general steps involved in the exemplary healthcheck device associated with the automatic door system of FIG. 1.

As shown in FIG. 2, the healthcheck module 22 may comprise an algorithm or a predetermined series of steps S1-S5 to be executed in addition to or in conjunction with those of the control unit 16. For example, in a step S1, the healthcheck module 22 may determine a current status of the door 12 by reading the output of the door position sensor 18. In particular, the healthcheck module 22 may determine if the door 12 is currently opening, closing, fully opened, fully closed, partially opened, or the like. Based on the door position, for example, if the door 12 is opened but needs to close, the healthcheck module 22 may begin reading the output of the obstruction signal 19, as in step S2. In a step S3, the healthcheck module 22 may correlate the door position signal with the obstruction signal to discover any signs of abnormalities. More specifically, the healthcheck module 22 may compare the detected door position and obstruction signals with predetermined thresholds and/or guidelines to determine the degree of caution with which to proceed. Based on the correlation and depending on the desired configuration, the healthcheck module 22 may transmit instruction signals to the drive unit 14 in a step S4 in order to stop the door 12, open the door 12 at normal speed, open the door 12 at a slower speed, close the door 12 at normal speed, close the door 12 at a slower speed, or the like. For example, if the healthcheck module 22 determines a relatively high probability of a malfunction in step S3, instruction signals may be transmitted to the drive unit 14 to open or close the door 12 at a speed that is slower than a predefined default or normal speed. To finally approve or disapprove functionality, the healthcheck module 22 may again check the resulting door position in a step S5 to determine if the instructions that were transmitted in step S4 were properly executed. For example, if the healthcheck module 22 expected the pathway of the door 12 to be blocked, but the door 12 was able to fully close, or if the healthcheck module 22 expected the pathway of the door 12 to be unobstructed, but the door 12 was unable to fully close, the healthcheck module 22 may declare the door system 10 as malfunctioning.

If the door system 10 is determined to be malfunctioning, the healthcheck module 22 may further respond in an optional step S6 by, for example, ending all operations of the door system 10 and/or notifying users, passengers, administrators, maintenance personnel, or the like, of the malfunction. Accordingly, the door system 10 may include a notification system 24, as shown in phantom lines in FIG. 1, configured to receive such indications of a malfunction from the healthcheck module 22 and automatically call attention to the door system 10. For example, the notification system 24 may include a device having a user interface such as a computer, server, mobile device, or the like, that may be connected to a network. In the event of a critical malfunction, the notification system 24 may request attention from administrators, maintenance personnel, local police and fire departments, or the like.

Figure 3:
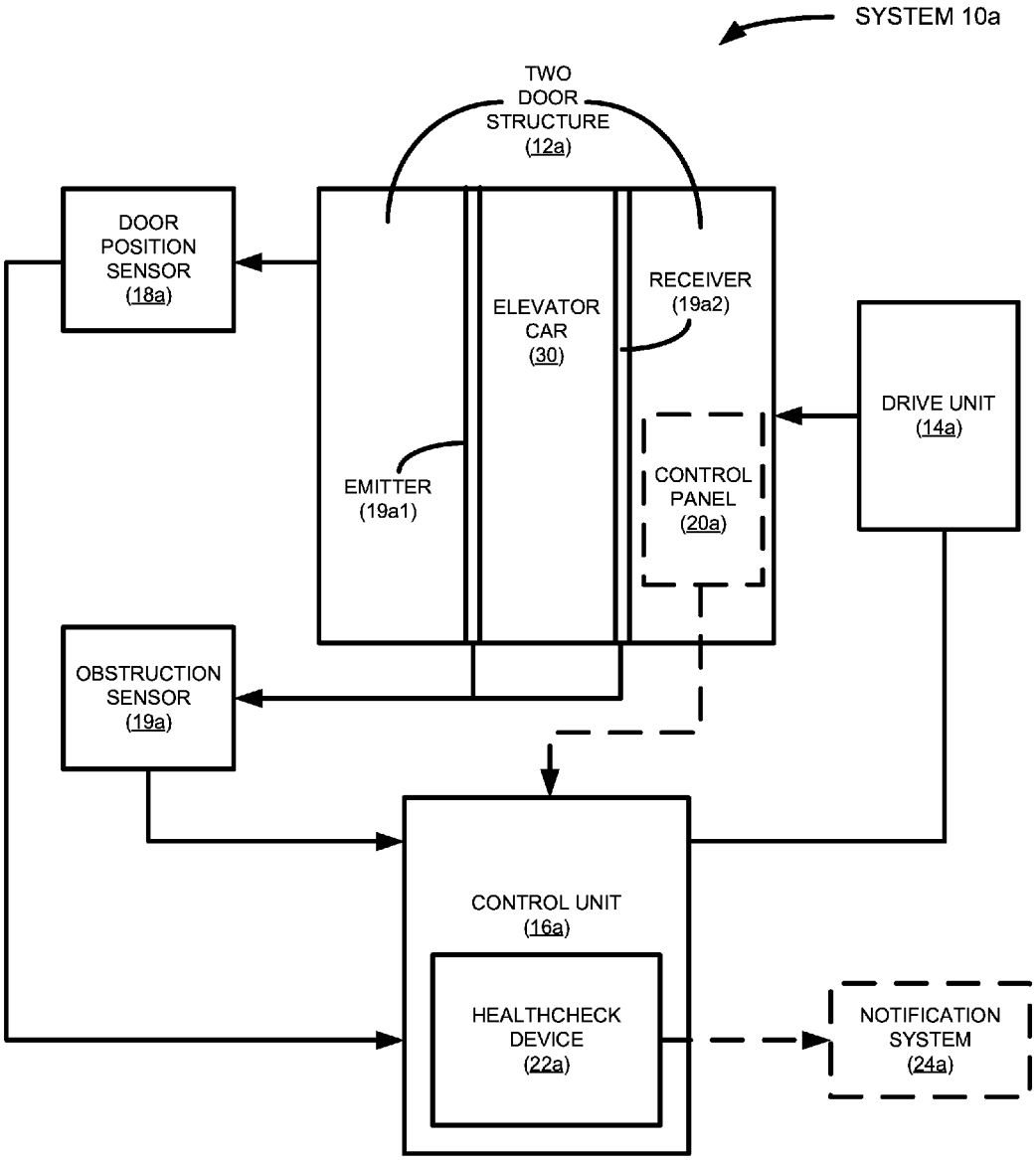
FIG. 3 is a schematic of a door system employing another embodiment of a healthcheck device.

Referring now to FIG. 3, a door system 10*a* employing an exemplary healthcheck device 22*a* is provided. The door system 10*a* may provide entry to or exit from a structure such as a building, vehicle, garage, or the like. For example, as shown in FIG. 3, the door system 10*a* may be part of an elevator car 30. As shown, the elevator door system 10*a* may include a split two-door structure 12*a* slidably movable between open and closed positions. Movement of the doors 12*a* may be provided by a drive unit 14*a*, such as a motor, or the like. Control of the movement of the doors 12*a* may be managed by a control unit 16*a*. The door system 10*a* may further include a door position sensor 18*a* configured to detect the current state (i.e., location and direction, if any, of travel) of the movable doors 12*a* and one or more obstruction sensors 19*a* configured to detect an obstruction in the pathway of the movable doors 12*a*.

In particular, the door position sensor 18*a* may be an encoder that is associated with the drive unit 14*a* which outputs a signal corresponding to the current position of the doors 12*a*. Alternatively, the door position sensor 18*a* may be a mechanical latch, switch, or the like, configured to output a signal indicating whether the doors 12*a* are opened or closed. The obstruction sensor 19*a* may be a proximity sensor which detects a passenger or obstruction in the vicinity of or in the pathway of the doors 12*a*. Moreover, the obstruction sensor 19*a* may include one or more emitters 19*a*1 and receivers 19*a*2 respectively disposed along the inner edges of the sliding doors 12*a*. Each emitter 19*a*1 may be configured to emit radiation or light to a corresponding receiver 19*a*2. Each receiver 19*a*2 may output a signal corresponding to the amount of radiation received. Accordingly, a break in the light or radiation received by a receiver 19*a*2 caused by a user, passenger or obstruction in the pathway of the doors 12*a* may result in a significant change in the output signal for the duration of the blockage. The elevator door system 10*a* may also include a control panel 20*a* configured to allow users to input commands for opening the doors 12*a*, closing the doors 12*a*, selecting the desired destination or floor, and the like.

As in previous embodiments, the control unit 16*a* may be a microcontroller, microprocessor, or the like, that is preprogrammed or embedded with a predetermined algorithm for operating the elevator doors 12*a*. As shown in FIG. 3, the control unit 16*a* may be in electrical communication with the outputs of the door position sensor 18*a*, the obstruction sensor 19*a* and the control panel 20*a*. The control unit 16*a* may also be in electrical communication with the input of the drive unit 14*a*. Among other things, the control unit 16*a* may monitor the signals provided by the sensors 18*a*, 19*a* for unsafe conditions and respond accordingly. For example, if the output of the obstruction sensor 19*a* indicates an obstruction in the pathway of the doors 12*a* while the output of the door position sensor 18*a* indicates that the doors 12*a* are closing, the control unit 16*a* may be preprogrammed to output signals instructing the drive unit 14*a* to stop closing the door, reopen the door, or the like. The elevator door system 10*a* of FIG. 3 also provides a healthcheck module 22*a* which serves to monitor the health or functionality of the door system 10*a*, and more particularly, the reliability of the sensors 18*a*, 19*a*.

Figure 4:
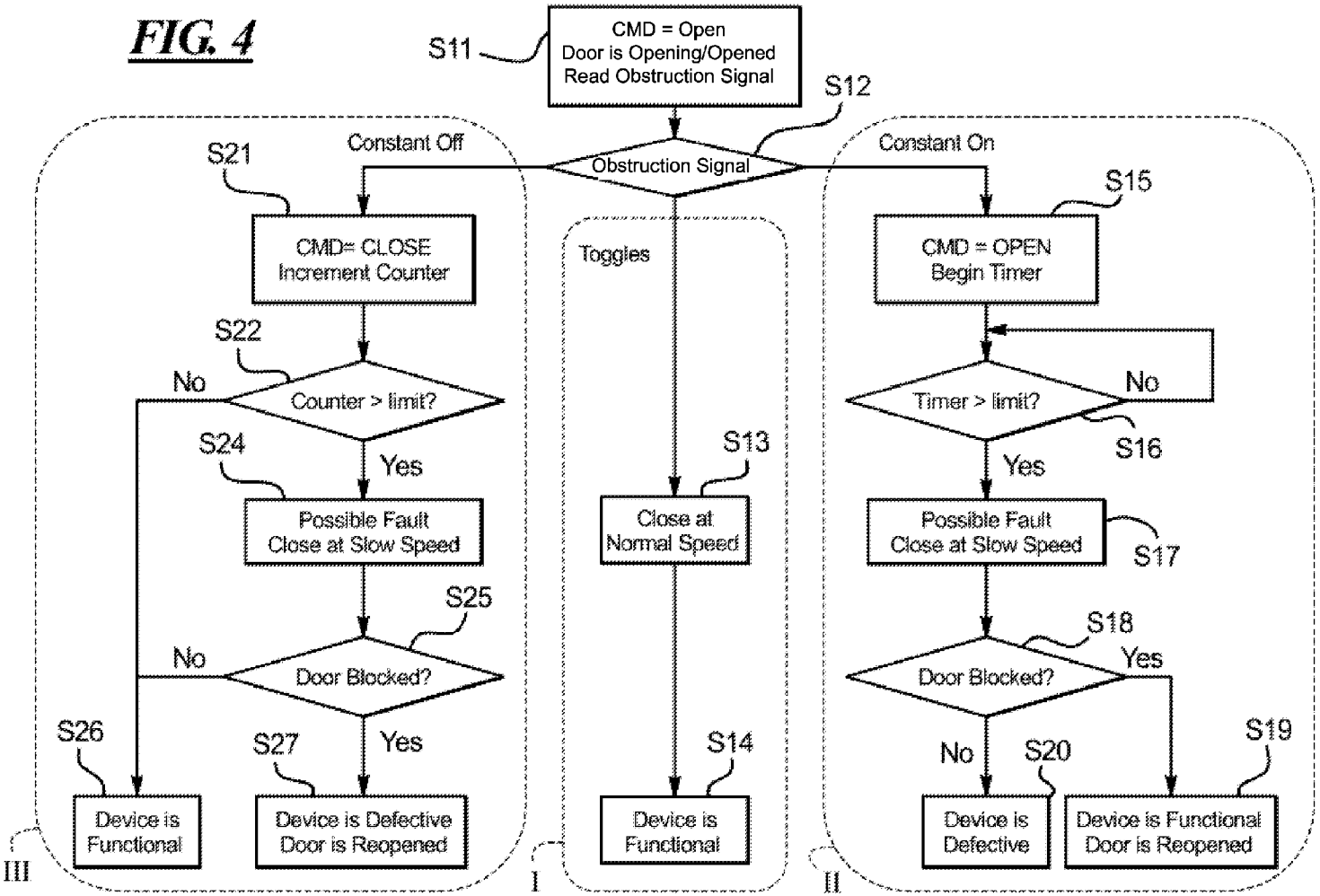
FIG. 4 is a flow chart outlining the operational steps involved in the exemplary healthcheck device associated with the door system of FIG. 3.

Turning to FIG. 4, a flow chart outlining the operational steps involved in the healthcheck device 22*a* associated with the elevator door system 10*a* of FIG. 3 is provided. As shown, the healthcheck device 22*a* may be initiated, in step S11, when an initial command CMD is set to 'Open,' wherein the door 12*a* is opening or opened. The healthcheck device 22*a* may first observe, in step S12, the obstruction or reversal signal provided by the obstruction sensor 19*a* to determine if there are any signs of an obstruction in a pathway of the elevator doors 12*a*. Depending on the reversal signal, the healthcheck device 22*a* may proceed in accordance with a predefined normal state I, first abnormal state II, second abnormal state III, or the like.

In the elevator door system 10*a* of FIG. 3, a toggled reversal signal observed in step S12 may correspond to a normal state I, wherein a passenger may have simply entered or exited through the elevator doors 12*a*. As the toggle in the reversal signal may indicate an obstruction sensor 19*a* capable of detecting an obstruction and that an obstruction is no longer present, the healthcheck device 22*a* may deem it safe to close the elevator doors 12*a* at a normal speed in step S13 and conclude that the door system 10*a* is functional in step S14.

If in step S12, a constantly active obstruction or reversal signal, for example, a reversal signal that is constantly 'On' or logically 'High' while the doors 12*a* are opening or opened, is observed, such a signal may correspond to a first abnormal state II. The first abnormal state II may indicate a true obstruction in the pathway of the doors 12*a*, or alternatively, a malfunctioning obstruction sensor 19*a* that is outputting an incorrect signal. In response, the healthcheck device 22*a* may initiate, in step S15, a timer, so as to allow time for the obstruction to pass or clear, for example, if it is a passenger that is taking longer than usual to get inside the elevator 10*a*. Once the timer has reached, in step S16, a predetermined limit or threshold, however, the healthcheck device 22*a* may instruct, in step S17, the drive unit 14*a* to begin closing the doors 12*a* with caution, or at a slower speed than default. Without such a timeout condition as in the prior art, a door system may leave its doors permanently open, prematurely assume elevator blockage and possibly transmit false alerts indicating same. Subsequently, when the doors 12*a* are closing, the healthcheck device 22*a* may, in step S18, observe the door position signal to determine if the doors 12*a* are in fact able to fully close, i.e., unblocked. If the doors 12*a* are indeed blocked from closing properly and forced to reopen, this is in accordance with the constantly active reversal signal, and thus, the door system 10*a* may, in step S19, be deemed as functional. However, if the doors 12*a* are not blocked and able to properly close, this is not in accordance with the constantly active reversal signal, and thus, the door system 10*a* may, in step S20, be deemed as malfunctioning. If the elevator door system 10*a* is determined to be malfunctioning, the healthcheck device 22*a* may optionally output signals to a notification system 24*a* to call attention to the elevator door system 10*a*.

If in step S12, a constantly inactive obstruction or reversal signal, for example, a reversal signal that is constantly 'Off or logically Tow' while the doors 12*a* are opening or opened, is observed, such a signal may correspond to a second abnormal state III. Such a constantly inactive reversal signal may be quite normal. But if the reversal signal is found to be inactive for each cycle it is observed and for several consecutive cycles, it may be suspected as a malfunction. More specifically, the second abnormal state III may simply be indications of no passengers or obstructions in the vicinity of the elevator doors 12*a* for a prolonged period of time, or alternatively, a malfunctioning obstruction sensor 19*a* that is unable to detect obstructions and is outputting an incorrect signal. Therefore, to more accurately classify the inactive reversal signal as functional or malfunctional, the healthcheck device 22*a* may, in step S21, increment a counter at each cycle the reversal device was determined to be off while the doors 12*a* were opening or opened. If the counter has not reached a predefined limit or threshold, the reversal device may be determined to be healthy and the doors 12*a* operate as commanded from the controller. However, if the counter has reached the limit or threshold, the healthcheck device 22*a* may, in step S24, determine a relatively higher risk of malfunction and instruct the drive unit 14*a* to begin closing the doors 12*a* with caution, or at a slower speed than default. Subsequently, the healthcheck device 22*a* may, in step S25, observe the door position signal to determine if the doors 12*a* are able to fully close, i.e., unblocked. If the doors 12*a* are indeed able to close properly, this is in accordance with the constantly inactive reversal signal in the second abnormal state III, and thus, the door system 10*a* may, in step S26, be deemed as functional. However, if the doors 12*a* are blocked and unable to close, this is not in accordance with the constantly inactive reversal signal, and thus, the door system 10*a* may, in step S27, be deemed to be malfunctioning. If the elevator door system 10*a* is determined to be malfunctioning, the healthcheck device 22*a* may optionally output signals to a notification system 24*a* to call attention to the elevator door system 10*a*.

Figure 5:
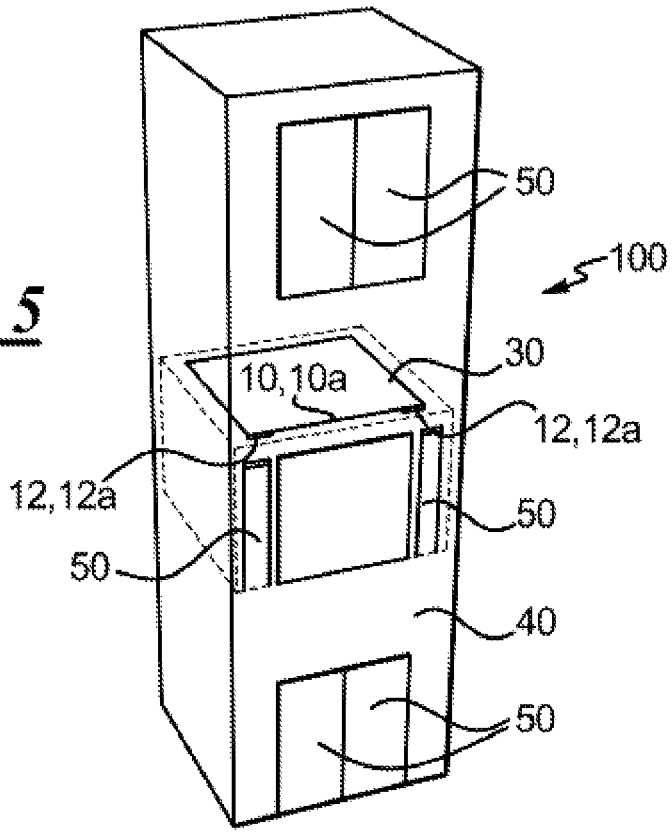
FIG. 5 is a perspective view of an embodiment of an elevator system that includes a door system of one of the foregoing embodiments.

An embodiment of an elevator system 100 is shown in FIG. 5. The elevator system 100 includes a hoistway 40 that includes a series of hoistway doors 50 at each landing. An elevator car 30, which is configured for vertical movement in the hoistway 40, includes a door system. The door system of the elevator car 30 may be one of the door system embodiments 10, 10*a* previously described.

Based on the foregoing, it can be seen that the present disclosure may provide automatically operating door systems and structures with a reliable healthcheck method and apparatus that overcomes deficiencies in the prior art. More specifically, the present disclosure provides a redundant, cost-effective and self-reliant safety device for automatic door systems that may easily be implemented into both new and existing automatic door systems without requiring the addition of substantial hardware. The present disclosure additionally provides a healthcheck device that is capable of automatically responding to a detected malfunction by notifying the respective personnel, sounding an alarm, shutting down operation of the door, or the like.

The aforementioned discussion is intended to be merely illustrative of the present invention and should not be construed as limiting the appended claims to any particular embodiment or group of embodiments. Thus, while the present invention has been described in particular detail with reference to specific exemplary embodiments thereof, it should also be appreciated that numerous modifications and changes may be made thereto without departing from the broader and intended scope of the invention as set forth in the claims that follow.

The specification and drawings are accordingly to be regarded in an illustrative manner and are not intended to limit the scope of the appended claims. In light of the foregoing disclosure of the present invention, one versed in the art would appreciate that there may be other embodiments and modifications within the scope of the present invention. Accordingly, all modifications attainable by one versed in the art from the present disclosure within the scope of the present invention are to be included as further embodiments of the present invention. The scope of the present invention is to be defined as set forth in the following claims.

What is claimed is:

1. A method for determining functionality of an automatically closing door system, comprising the steps of:

monitoring an obstruction signal output by a first sensor configured to detect an obstruction in a pathway of a door of the door system, the obstruction signal corresponding to one of at least three states including a normal state, a first abnormal state and a second abnormal state;

closing the door at a first speed if the obstruction signal corresponds to the normal state; closing the door at a second speed if the obstruction signal corresponds to any one of the first and second abnormal states, the second speed being slower than the first speed, the first abnormal state corresponding to a consistently active obstruction signal and the second abnormal state corresponding to a consistently inactive obstruction signal;

monitoring a door position signal output by a second sensor configured to detect a current position of the door, the door position signal corresponding to one of at least three states including a closed state, an open state and a blocked state;

determining if the first sensor is malfunctioning if the obstruction signal corresponds to the first abnormal state and the door position signal corresponds to the closed state, or if the obstruction signal corresponds to the second abnormal state and the door position signal corresponds to the blocked state; and declaring the door system as malfunctioning if the first sensor is malfunctioning.

2. The method of claim 1 further comprising a step of declaring the door system as functional if the obstruction signal corresponds to the normal state, the obstruction signal corresponds to the first abnormal state and the door position signal corresponds to the blocked state, or the obstruction signal corresponds to the second abnormal state and the door position signal corresponds to the closed state.

3. The method of claim 1 further comprising a step of triggering an alert to call attention to the door system if the door system is determined to be malfunctioning.

4. The method of claim 1, wherein the normal state corresponds to a toggle in the obstruction signal.

5. The method of claim 1, wherein, during the first abnormal state, the door system is closed at the second speed only after a predetermined time has elapsed.

6. The method of claim 1, wherein, during the second abnormal state, the door system is closed at the second speed only after a counter exceeds a predetermined limit, the counter configured to increment only when the obstruction signal corresponds to the second abnormal state.

7. An automatic door system, for an elevator system, capable of determining proper functionality thereof, comprising:

at least one door automatically movable along a pathway of the door system, the at least one door being disposed in an elevator car of the elevator system;

at least one obstruction sensor configured to detect an obstruction in the pathway and output an obstruction signal;

at least one position sensor configured to detect a position of the door along the pathway and output a position signal;

a control unit configured to receive the obstruction and position signals and output command signals;

a drive unit configured to receive the command signals from the control unit and drive the door; and a healthcheck module configured to:

monitor a correlation between the obstruction and position signals;

determine if the correlation is indicative of malfunction associated with the at least one obstruction sensor;

determine if the door system is malfunctioning based on if the correlation is indicative of malfunction associated with the at least one obstruction sensor; and call attention to the door system if the door system is malfunctioning.

8. The automatic door system of claim 7, wherein the obstruction sensor comprises at least one emitter and at least one receiver, the emitter configured to emit radiation across the pathway to be received by the receiver, the obstruction signal corresponding to the amount of radiation that is received at the receiver.

9. The automatic door system of claim 7, wherein the healthcheck module is configured to classify the obstruction signal as one of at least three states including a normal state, a first abnormal state and a second abnormal state, the first abnormal state corresponding to a consistently active obstruction signal and the second abnormal state corresponding to a consistently inactive obstruction signal, and wherein the door system is configured close the at least one door at a first speed if the obstruction signal corresponds to the normal state, close the at least one door at a second speed if the obstruction signal corresponds to any one of the first and second abnormal states, the second speed being slower than the first speed.

10. The automatic door system of claim 9, wherein the healthcheck module is configured to classify the door position signal as one of at least three states including a closed state, an open state and a blocked state, and declare the least one obstruction sensor as malfunctioning if the obstruction signal corresponds to the first abnormal state and the door position signal corresponds to the closed state, or the obstruction signal corresponds to the second abnormal state and the door position signal corresponds to the blocked state.

11. The automatic door system of claim 9, wherein the normal state corresponds to a toggle in the obstruction signal.

12. The automatic door system of claim 9, wherein, during the first abnormal state, the door system is closed at the second speed only after a predetermined time has elapsed.

13. The automatic door system of claim 9, wherein, during the second abnormal state, the door system is closed at the second speed only after a counter exceeds a predetermined limit, the counter configured to increment only when the obstruction signal corresponds to the second abnormal state.

14. The automatic door system of claim 7, wherein the healthcheck module is configured to trigger an alert to call attention to the door system if the door system is determined to be malfunctioning.

15. An elevator system comprising:

a hoistway having one or more hoistway doors;

a car configured to move vertically within the hoistway, the car having a door system, the door system being capable of determining proper functionality thereof, the door system comprising:

at least one door automatically movable along a pathway of the door system;

at least one obstruction sensor configured to detect an obstruction in the pathway and output an obstruction signal;

at least one position sensor configured to detect a position of the door along the pathway and output a position signal;

a control unit configured to receive the obstruction and position signals and output command signals;

a drive unit configured to receive the command signals from the control unit and drive the elevator door; and a healthcheck module configured to:

monitor a correlation between the obstruction and position signals;

determine if the correlation is indicative of malfunction associated with the at least one obstruction sensor;

determine if the door system is malfunctioning based on if the correlation is indicative of malfunction associated with the at least one obstruction sensor; and call attention to the door system if the door system is malfunctioning.

16. The elevator system of claim 15, wherein the obstruction sensor comprises at least one emitter and at least one receiver, the emitter configured to emit radiation across the pathway to be received by the receiver, the obstruction signal corresponding to the amount of radiation that is received at the receiver.

17. The elevator system of claim 15, wherein the healthcheck module is configured to classify the obstruction signal as one of at least three states including a normal state, a first abnormal state and a second abnormal state, the first abnormal state corresponding to a consistently active obstruction signal and the second abnormal state corresponding to a consistently inactive obstruction signal, and wherein the door system is configured to close the at least one door at a first speed if the obstruction signal corresponds to the normal state, close the at least one door at a second speed if the obstruction signal corresponds to any one of the first and second abnormal states, the second speed being slower than the first speed.

18. The elevator system of claim 17, wherein the health-check module is configured to classify the elevator door position signal as one of at least three states including a closed state, an open state and a blocked state, and declare the at least one obstruction sensor as malfunctioning if the obstruction signal corresponds to the first abnormal state and the door position signal corresponds to the closed state, or the obstruction signal corresponds to the second abnormal state and the door position signal corresponds to the blocked state.

19. The elevator system of claim 17, wherein the normal state corresponds to a toggle in the obstruction signal.

20. The elevator system of claim 17, wherein, during the first abnormal state, the door system is closed at the second speed only after a predetermined time has elapsed.

21. The elevator system of claim 17, wherein, during the second abnormal state, the door system is closed at the second speed only after a counter exceeds a predetermined limit, the counter configured to increment only when the obstruction signal corresponds to the second abnormal state.

* * * * *